US006612831B1

(12) United States Patent
Ansquer et al.

(10) Patent No.: US 6,612,831 B1
(45) Date of Patent: Sep. 2, 2003

(54) PYROPHOROUS IGNITION LIGHTER

(75) Inventors: Henri Ansquer, Quimper (FR); André Le Borgne, Guidel (FR)

(73) Assignee: Hameur, Luxembourg (LU)

( * ) Notice: Subject to any disclaimer, the term of this patent is extended or adjusted under 35 U.S.C. 154(b) by 103 days.

(21) Appl. No.: 09/686,887

(22) Filed: Oct. 12, 2000

(30) Foreign Application Priority Data

Oct. 12, 1999 (FR) ..... 99 12676

(51) Int. Cl.[7] ..... F23Q 2/16; F23Q 2/46; F23Q 2/50

(52) U.S. Cl. ..... 431/153; 431/277

(58) Field of Search ..... 431/277, 153

(56) References Cited

U.S. PATENT DOCUMENTS

| | | | | | |
|---|---|---|---|---|---|
| 1,702,121 | A | * | 2/1929 | Knapp | 431/136 |
| 4,717,335 | A | * | 1/1988 | Loveless | 431/153 |
| 4,822,276 | A | * | 4/1989 | Bisbee | 431/153 |
| 5,085,578 | A | * | 2/1992 | Hunter | 431/153 |
| 5,236,351 | A | * | 8/1993 | Tien | 431/153 |
| 5,271,731 | A | * | 12/1993 | Hsin-Chung | 431/153 |
| 5,439,375 | A | * | 8/1995 | Wang | 431/153 |
| 5,460,516 | A | * | 10/1995 | Sher | 431/153 |
| 5,490,773 | A | * | 2/1996 | Lloveras Capilla | 431/153 |
| 5,584,683 | A | * | 12/1996 | Sher | 431/153 |
| 5,597,299 | A | * | 1/1997 | Jon | 431/153 |
| 5,634,787 | A | * | 6/1997 | Frigiere | 431/153 |
| 5,655,902 | A | * | 8/1997 | Doucet | 431/153 |
| 5,676,537 | A | * | 10/1997 | Fang | 431/153 |
| 5,735,294 | A | * | 4/1998 | McDonough et al. | 131/329 |
| 5,743,725 | A | * | 4/1998 | Chan | 431/153 |
| 5,769,625 | A | * | 6/1998 | Sher | 431/153 |
| 5,957,680 | A | * | 9/1999 | Doucet et al. | 431/153 |
| 5,971,748 | A | * | 10/1999 | Rogelet | 431/153 |

FOREIGN PATENT DOCUMENTS

| | | |
|---|---|---|
| EP | 0672867 | 3/1997 |
| FR | 2731775 | 9/1996 |
| FR | 2736420 | 1/1997 |
| WO | 95/04247 | 2/1995 |
| WO | 96/41103 | 12/1996 |

* cited by examiner

*Primary Examiner*—Carl D. Price
(74) *Attorney, Agent, or Firm*—Greenblum & Bernstein, P.L.C.

(57) ABSTRACT

Gas lighter having a safety mechanism. The lighter includes a lighter body housing a tank of liquefied gas under pressure. A valve allows passage of gas. A burner is connected to the valve. A push-button is disposed on the body and is adapted to be pressed by a user's finger. A lever is used for acting on the valve. The lever is adapted to cooperate with the push-button. A wheel is used for engaging a flint. The wheel includes at least one driver. A spring is arranged below the flint for biasing the flint against the wheel. An axle is used upon which the wheel is rotatably mounted. A mechanism is used for preventing the rotation of the wheel. The mechanism is adapted to engage at least one tooth on the at least one driver so as to prevent the rotation of the wheel.

18 Claims, 10 Drawing Sheets

FIG.3
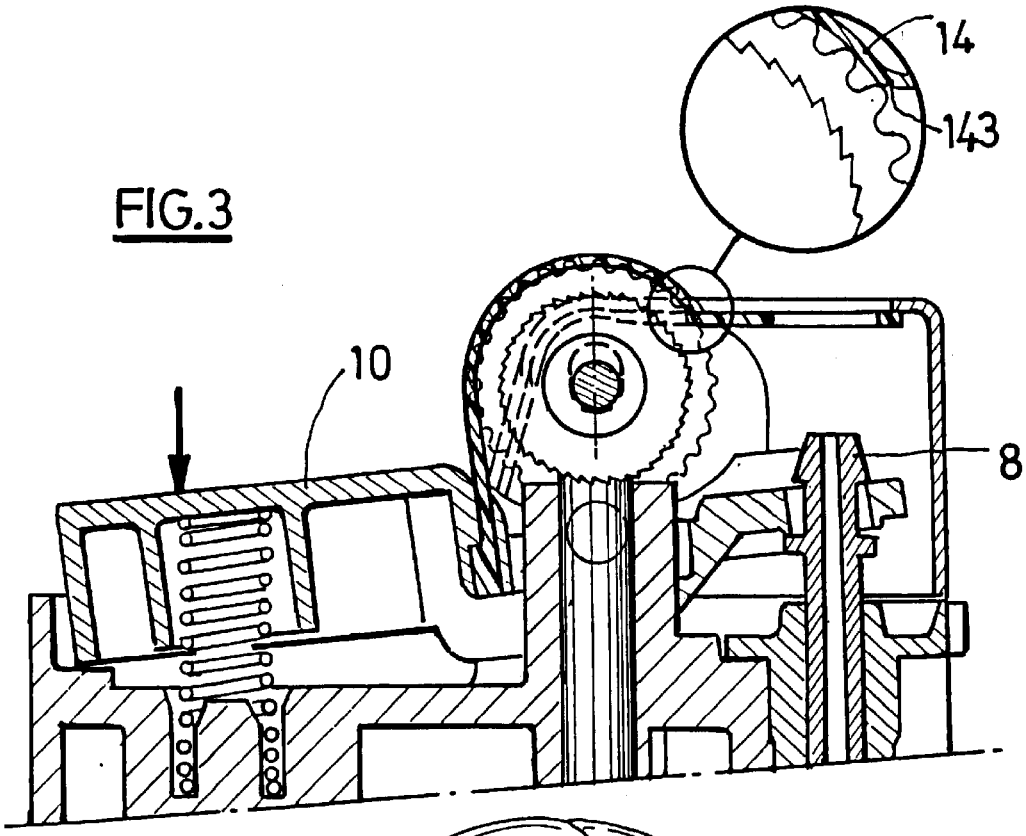
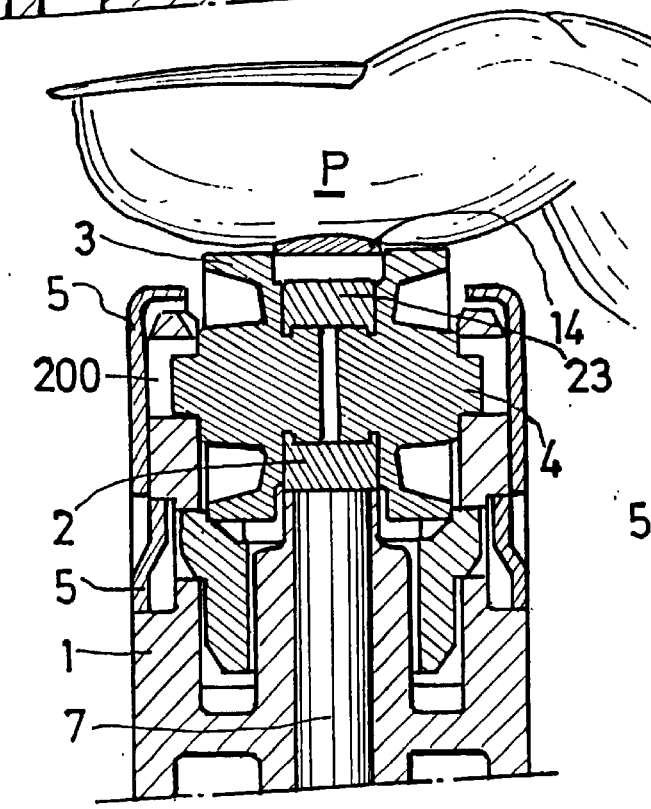
FIG.4
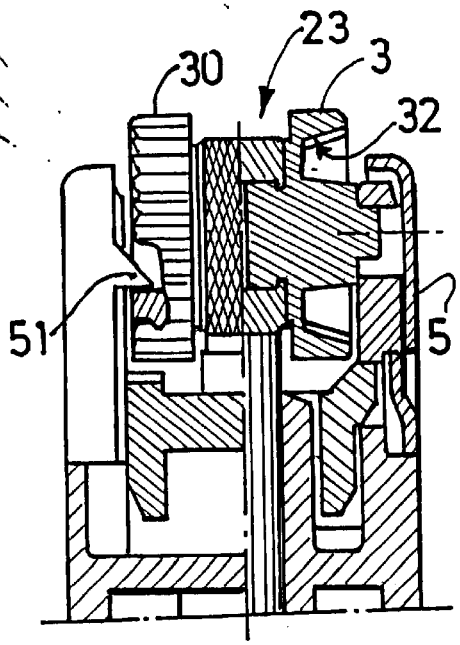
FIG.10

FIG.14
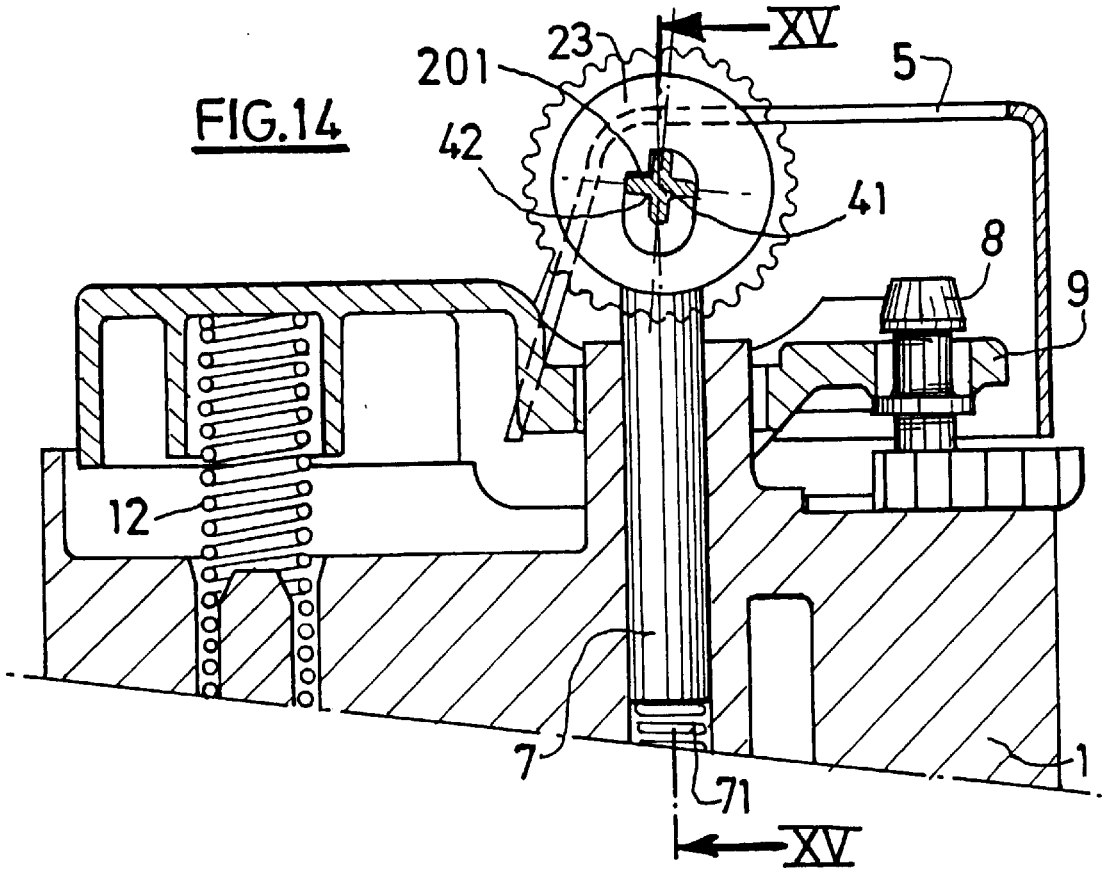
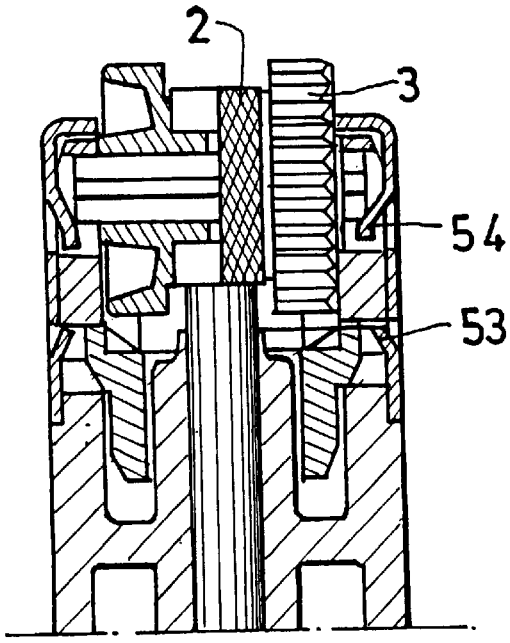
FIG.15
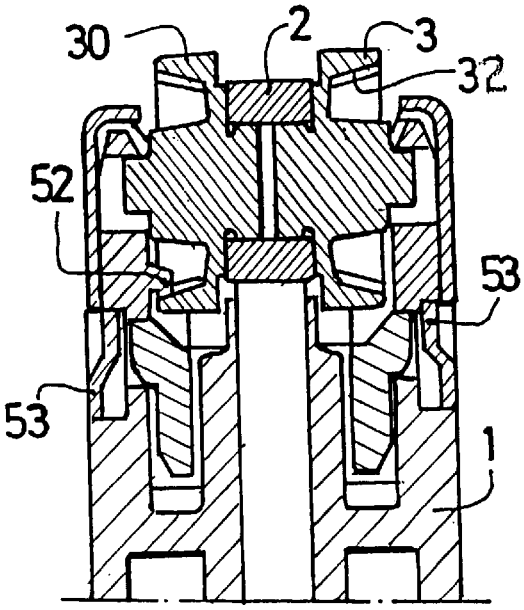
FIG.13

PYROPHOROUS IGNITION LIGHTER

CROSS-REFERENCE TO RELATED APPLICATIONS

The instant application is based upon French priority Patent Application No. 99 12676, filed Oct. 12, 1999, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a gas lighter, with flint and wheel ignition, provided with a safety device adapted, particularly but not exclusively, to prevent the use of such a lighter by persons, such as children, who are normally incapable of appreciating the potential danger of a flame.

2. Background and Material Information

A conventional disposable lighter includes a body housing a tank of liquefied gas under pressure, a control lever acting on a valve for the passage of the gas, and one planar end of which constitutes the push-button which will be pressed down by the user's finger, a wheel, a flint in contact with the wheel, and a pressure reducing valve transforming the liquefied gas into a gas that can escape by the burner. The wheel is usually surrounded on both sides by toothed, corrugated, or grooved drivers to prevent slipping, with a greater diameter than that of the wheel, which reduce the force that is necessary for the rotation thereof and avoid a direct contact of the hand with the wheel that is always loaded with dust.

The ignition of the lighter requires two conditions, namely the simultaneous presence of sparks and of the transformed gas, in a same zone above the burner. Numerous child-resistant safety devices have already been proposed, some of which have been put into operation, which aim at prohibiting the release of the gas.

Most of the devices proposed call for a removable blocking of the push-button, which prevents the latter from lowering, therefore from releasing the gas as long as a preliminary operation has not been performed. This often relates to the release of a safety lock. Prior to this operation, the push-button cannot open the valve and the as does not come out, since the formation of sparks not constituting a great danger.

A second type of safety aims at preventing the rotation of the wheel as long as a preliminary operation has not been completed, the movement of the push-button remaining to free. This can be either a forward movement of the drivers and of the wheel, or a vertical pressure on the drivers-wheel assembly that enables an engagement of the latter.

It has already been proposed to block the rotation of the wheel, in the extinguished position, by providing two positions thereof, a resting position and an operational or ignition position. For example, one can cite the documents EP-A-672 867 and FR-A-2736 420, in which the rotational axle common to the wheel and its drivers is movable, under the action of a pressure, in a rectilinear groove forming a cam, such that if the wheel is not pressed, the wheel attacks the flint in a position that is not tangent, which implies a blocking of the wheel by the flint.

In WO96/41103 and WO95/04247, a resiliently deformable guard is provided, which covers a portion of the wheel and is surrounded by drivers. This deformable element is connected to the body of the lighter. A sufficient pressure (which children generally cannot apply) must be exerted on the guard to deform it to be able to rotate the wheel and produce sparks. A finger or brake is provided to prevent the wheel from rotating when the push-button is pressed down, which would permit ignition by using two hands.

In FR-A-2731775, the drivers are configured so that the wheel can be driven only under the action of a relatively large thumb, which is not the case with children's thumbs which cannot rotate the wheel to produce sparks, the release of gas remaining possible at all time.

However, none of these systems perfectly meet the requirements of the authorized users who wish as easy a usage as possible, without damaging the fingers.

SUMMARY OF THE INVENTION

The object of the present invention is to overcome the disadvantages of the known devices, and to propose a solution to the problem of child safety by blocking the wheel.

According to the invention, the safety device for a gas lighter including a body housing a tank of liquefied gas under pressure, a lever forming, at its rear portion, a push-button which can be pressed down by the user's finger, acting on a valve for the passage of the gas connected to a burner, a wheel, a flint in contact with the wheel, the wheel being surrounded on both sides by drivers, the assembly being pivotally mounted about an axle taking support in a cover projecting on the upper portion of the body of the lighter and partially surrounded by a cap, is characterized in that the lighter has means for blocking the rotation of the wheel cooperating with at least one driver.

According to another characteristic of the invention, the blocking means are carried either by the protective cap, by the mounting cover of the axle of the ignition unit constituted by the wheel and its drivers, by the axle of the ignition unit, or yet by the push-button lever or by a wheel cover forming a guard.

According to yet another characteristic of the invention, the axle of the ignition assembly is movable between two positions, in one of which the drivers and the wheel are blocked, and in the other of which the drivers and therefore the wheel are free to rotate, which enables sparks to be generated.

According to still another characteristic of the invention, the blocking of the drivers is done by means of a wheel cover partially surrounding the latter.

The basic idea of the invention consists of blocking the wheel to prevent the formation of sparks, whether or not the push-button is pressed, to ensure a better resistance unauthorized uses.

The invention provides for a gas lighter having a safety mechanism, the lighter comprising a lighter body housing a tank of liquefied gas under pressure, a valve allowing a passage of gas, a burner connected to the valve, a push-button disposed on the body and adapted to be pressed by a user's finger, a lever for acting on the valve, the lever being adapted to cooperate with the push-button, a wheel for engaging a flint, the wheel comprising at least one driver, a spring arranged below the flint for biasing the flint against the wheel, an axle upon which the wheel is rotatably mounted, and a mechanism for preventing the rotation of the wheel, wherein the mechanism is adapted to engage at least one tooth on the at least one driver so as to prevent the rotation of the wheel.

The wheel may comprise at least two drivers, one located on each side of the wheel. The lighter may further comprise a cover disposed in an upper portion of the lighter and a cap at least partially surrounding the cover. The axle may be supported by the cover. The axle may be movable against a biasing force of the spring. The axle may be movably supported in a slot.

The lighter may further comprise a cover disposed adjacent the wheel, wherein the axle is movably mounted in rectilinear grooves disposed in the cover, and wherein the axle is movable between a low position in which the wheel is unable to rotate and a high position in which the wheel is prevented from rotating. The mechanism for preventing the rotation of the wheel may comprise a wheel cover. The wheel cover may comprise a plate having an edge and wherein the edge is adapted to engage the at least one tooth of the at least one driver so as to prevent the rotation of the wheel. The axle may be movable between a high position and a low position and wherein the edge is adapted to engage the at least one tooth when the axle is in the high position. The plate of the wheel cover may be slidable with respect to an inner surface of a cap surrounding the burner. The wheel cover may be one of fixed and connected to the lever. The wheel cover may comprise an end which is fixed to the lever via a connection, the connection being disposed between the wheel and the push-button. The wheel cover may comprise an end which is fixed to the lever via a connection, the connection being disposed between the wheel and the burner. The mechanism for preventing the rotation of the wheel may comprise a cap having at least one engaging lug, and the engaging lug may be engagable with at least one tooth disposed on the at least one driver. The axle may be movable against a biasing force of the spring. The axle may be movable between a high position and a low position and the at least one engaging lug may be adapted to engage the at least one tooth when the axle is in the high position. The mechanism for preventing the rotation of the wheel may comprise at least one engaging lug disposed on the body, and the engaging lug may be engagable with at least one tooth disposed on the at least one driver. The axle may be movable against a biasing force of the spring. The axle may be movable between a high position and a low position and the at least one engaging lug may be adapted to engage the at least one tooth when the axle is in the high position. The mechanism for preventing the rotation of the wheel may comprise a wheel cover, the wheel cover comprising a plate having a hole and an edge and the edge may be adapted to engage the at least one tooth of the at least one driver so as to prevent the rotation of the wheel. The mechanism for preventing the rotation of the wheel may comprise a wheel cover, the wheel cover comprising a plate having a hole for the passage of sparks and having a ring portion whose width is substantially equal to a width of the wheel. The ring portion may be circular in shape and is adapted to cover less than 270 degrees of the wheel.

The invention also provides for a gas lighter comprising a lighter body housing a tank of liquefied gas under pressure, a valve allowing a passage of gas, a burner connected to the valve, a push-button disposed on the body and adapted to be pressed by a user's finger, a lever for acting on the valve, the lever being adapted to cooperate with the push-button, a wheel for engaging a flint, the wheel comprising two drivers, a spring arranged below the flint for biasing the flint against the wheel, an axle mounted to a cover, the axle being movable between a high position and a low position, the wheel being rotatably mounted to the axle, a cap at least partially surrounding the cover, a wheel cover for preventing the rotation of the wheel, the wheel cover having a portion which at least partially surrounds the wheel, the wheel cover comprising an end which is fixed between the wheel and the push-button and another end which is free, the other end including a plate adapted to slide with respect to an inner surface of the cap, the plate comprising an edge adapted to engage at least one tooth of at least one of the drivers, wherein the wheel is prevented from rotating when the edge engages at least one tooth of at least one driver, and wherein the wheel is rendered rotatable when the axle of the wheel is moved away from the high position towards the low position.

The wheel may be prevented from rotating when the push-button is in a low position, and the wheel may be rendered rotatable when the axle of the wheel is moved away from the high position towards the low position.

BRIEF DESCRIPTION OF DRAWINGS

Other characteristics and advantages of the invention will become apparent from the following description of particular embodiments, which are provided only by way of non-limiting examples, with reference to the annexed drawings in which:

FIGS. 1, 2, 3 and 4 show views of a lighter according to the first embodiment;

FIGS. 8–10 show, in the same conditions, another embodiment in which the drivers include an outer crown and a toothed inner crown;

FIGS. 11, 12 and 13 show, in the same conditions, another embodiment in which the blocking mechanism is affixed to the body of the lighter, and more specifically to the mounting cover of the ignition assembly;

FIG. 14 shows another embodiment in which the blocking of the wheel occurs on the axle thereof;

FIG. 15 shows a cross-sectional view along the line XV—XV of FIG. 14;

DETAILED DESCRIPTION OF THE PREFERRED EMBODIMENTS

Figure 1:
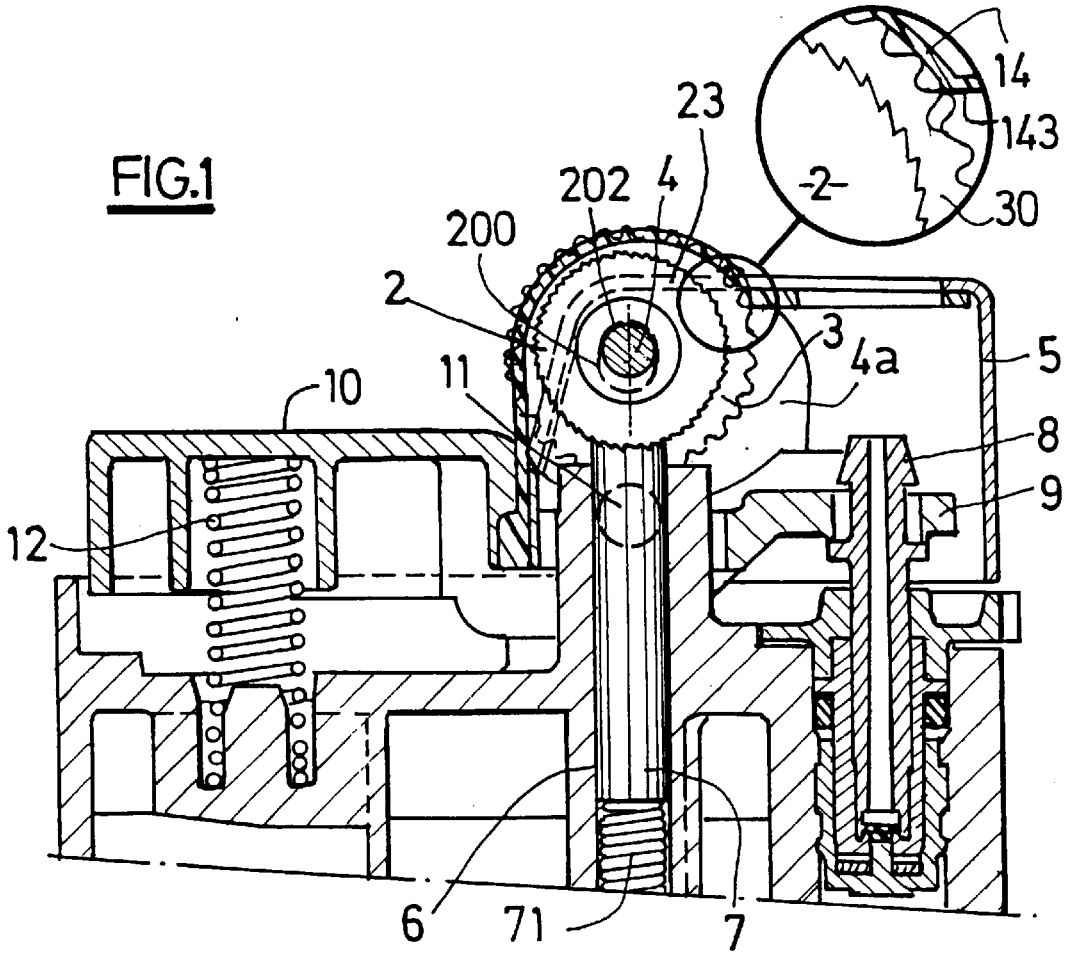

In all of the Figures, the same reference numerals designate the same elements. The lighter body 1 including a tank of liquefied gas (not shown) is provided at its upper portion, as known, with an ignition assembly 23 rotatably mounted on the body 1 of the lighter, including a wheel 2 rotationally affixed to drivers 3 (only one of which appears in the Figure), the assembly being swivelled in the body of the lighter by way of an axle 4 resting on a cover 4*a*. This assembly is partially covered by a cap 5 that extends from the front of the lighter, to the right of the Figure, up to the rear portion of the wheel-drivers assembly which it covers only in part. The periphery of the wheel 2 is always in contact with a cylindrical flint 7 which is pressed upwardly by a spring 71 in a cylindrical housing 6 formed in the body 1 of the lighter. The counter-clockwise rotation of the wheel 2 causes the projection of sparks above the burner 8.

The burner 8 can be raised toward the top to open an exhaust valve (not shown) for the gas contained in the tank included in the body 1, under the action of a lever 9 whose rear end constitutes a push-button 10, the surface of which can be pressed by the user's finger, generally the thumb. The lever 9 is pivotally mounted on the body 1 of the lighter via half-axles 11, in the extension of one another, swivelled in the cover 4*a* on both sides of the flint 7. The half-axles 11 are located beneath the axle 4 of the wheel 2. The push-button 10 is constantly returned toward the top (a position which it occupies in FIG. 1) by a spring 12 whose lower end rests on the bottom of a cavity of the lighter. Around the burner 8 can be arranged a spring (not shown) which makes it possible to delay the release of the gas, as known, when the lever 9 starts its upward movement. Of course, other valve configurations can be used without leaving the scope of the invention.

Figure 2:
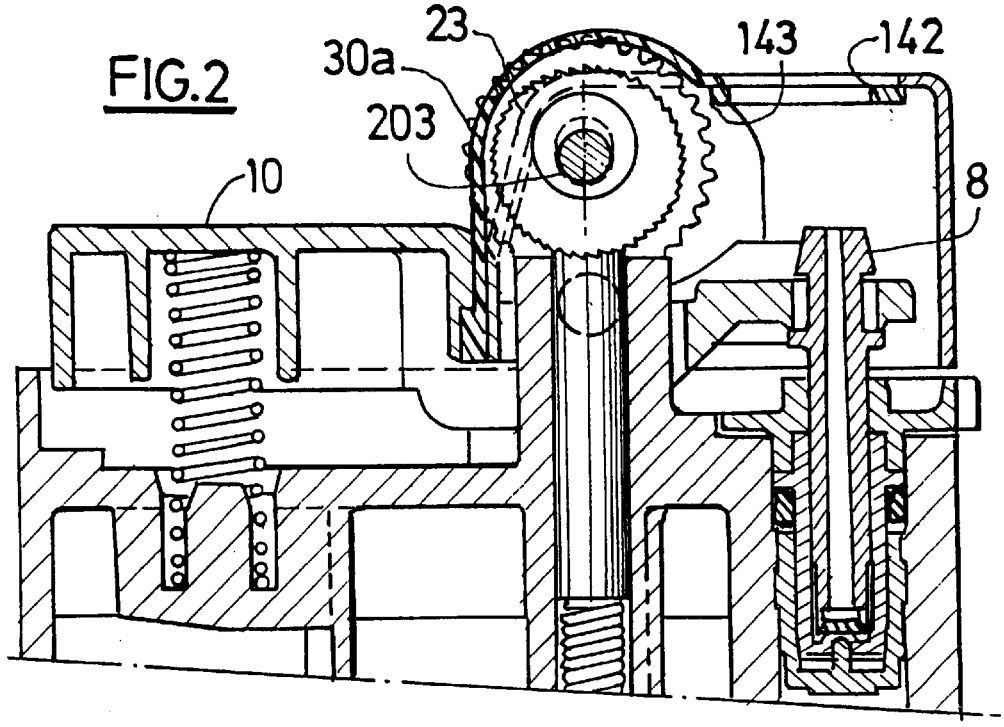

FIGS. 1–3 show a first embodiment that calls for a wheel cover during the various functioning steps. In this embodiment, the shape of the wheel cover is of the type of that shown in FIG. 19.

Figure 19:
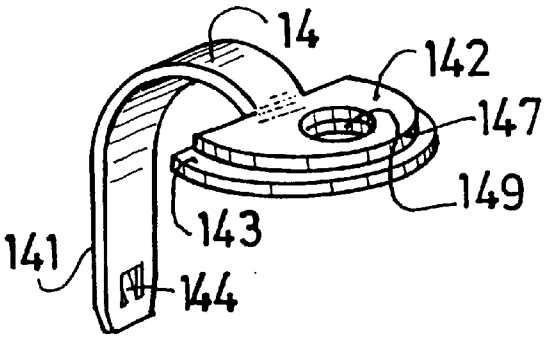
FIG. 19 shows a view of the wheel cover in the embodiment of FIGS. 1–4.

FIG. 19 shows a perspective view of the rigid wheel cover. It includes, in its front portion, a planar or cupel-shaped surface or plate 142 bored with a hole 149 for the passage of the gas, extended rearwardly by an edge 143 projecting with respect to the surface 142. From the rear portion of the surface 142 extends the wheel cover 14 itself, which is prolonged downwardly by a lug 141 that can be affixed to the push-button by a tab 144. The wheel cover 14 is prolonged frontwardly by the plate 142 which takes support against the lower surface of the cap 5, on which it can slide between two positions corresponding to the extinguished and ignition positions of the lighter, the front edge 147 of the plate 142 always remaining beneath the lower surface of the cap 5. The second arm 141 of the wheel cover is included in a transverse slit of the lever 9, in which its lower end is fixed.

The axle 4 of the ignition assembly 23 is slidably mounted in two oblong slots 200 provided in the cover 4*a* projecting above the body 1 of the lighter, on the upper portion of the latter. At rest, the spring 71 arranged beneath the flint 7, and whose object is normally to press the flint on the wheel 2, displaces the axle 4 of the latter against the top 202 of the oblong slot 200. It is the position that is shown in FIG. 1, in which the lighter is in the extinguished or resting position. As appears in the inset of FIG. 1, the edge 143 of the plate 142 is applied between two teeth 30 of the drivers 3, which prevents any rotation of the wheel 2, and therefore the production of sparks. And if one presses down on the push-button 10, the wheel 2 remains blocked.

In FIG. 2, the lighter is in the "ready" position for ignition, which is obtained by rotating the ignition assembly 23 and immediately pressing on the push-button 10. This position is obtained by a pressure, toward the bottom of the Figure, on the ignition assembly 23 that takes support against the edge 203 of the slots 200, only one of which appears in the Figures. The wheel cover 14 remains in its initial position. As a result, the teeth 30 of the driver 3 escape from the rear edge 143 of the plate 142, and the wheel 2 can be rotationally driven.

In FIG. 3, after the lowering of the axle 4 of the ignition assembly 23, the push-button 10 has been pressed and the flame can be generated; this is the ignition position. But as soon as the push-button is pressed down, the wheel cover 14 is driven toward the rear of the lighter, and the rear edge 143 of the plate 142 is once again engaged between two teeth 30 of at least one driver, such that the wheel can no longer be rotated. The release of the push-button 10 causes the movement of the wheel cover 14 toward the front of the lighter and the release of the edge 143 away from the teeth 30 to release the locking. However, under the action of the spring 71, the axle 4 rises back in the oblong slot or rectilinear groove 200 such that the edge 143 is once again between two teeth 30, as it appears in FIG. 1. This design ensures that it is no longer possible to rotate the wheel as soon as the push-button 10 has been pressed. The only case in which it is possible to undertake an ignition is that of FIG. 2, which first requires a pressure on the ignition assembly 23, then a pressure on the push-button 10 immediately after the rotation of the wheel 2.

By deformation of the user's thumb P, the latter can act on the drivers 3, as shown in FIG. 4, even the wheel cover 14 is slightly positioned above the driver 3 if, of course, the thumb P is that of an adult that is sufficiently large, this method of utilization being prohibited to children. This is what is shown in FIG. 4 which is a transverse cross-section along the line IV—IV of FIG. 3, in which one sees that the thumb P is squeezed on the wheel cover 14, which enables it to come in contact with the drivers 3.

Figure 5:
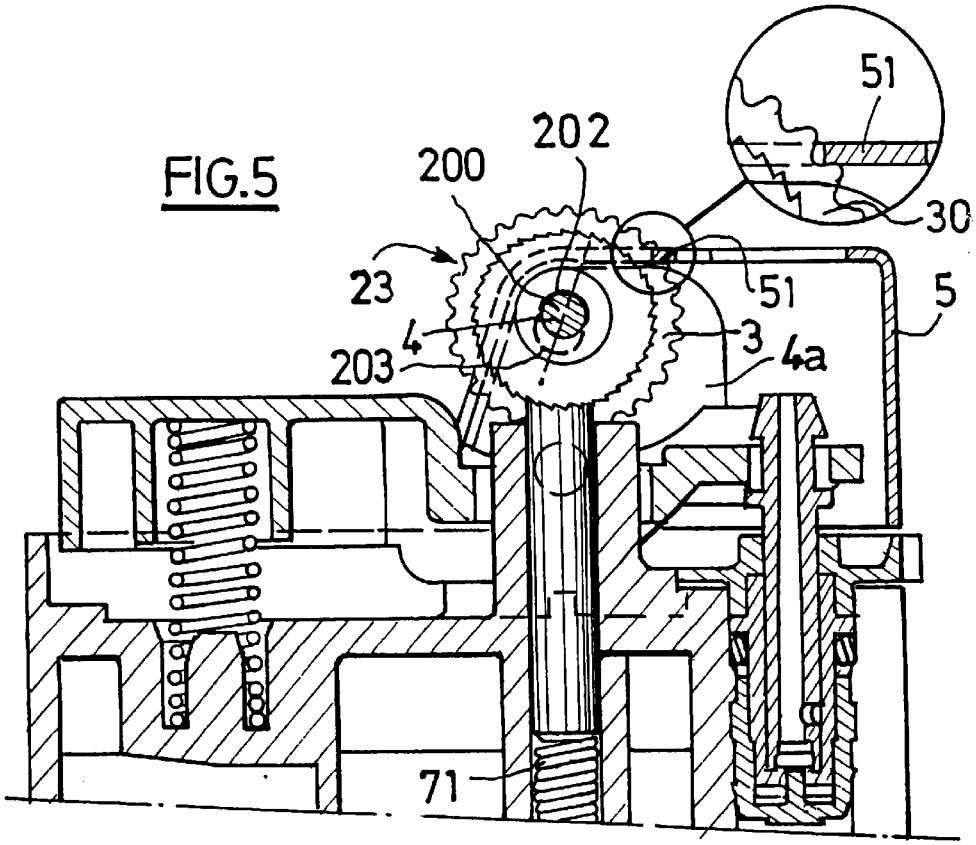
FIGS. 5, 6 and 7 show views of a second embodiment, a vertical cross-sectional view of the upper portion of a lighter in the extinguished position (FIG. 5), in the ignition position (FIG. 6), and a top view (FIG. 7) in which the blocking of the wheel is obtained by a projecting piece within the cap, respectively.
Figure 6:
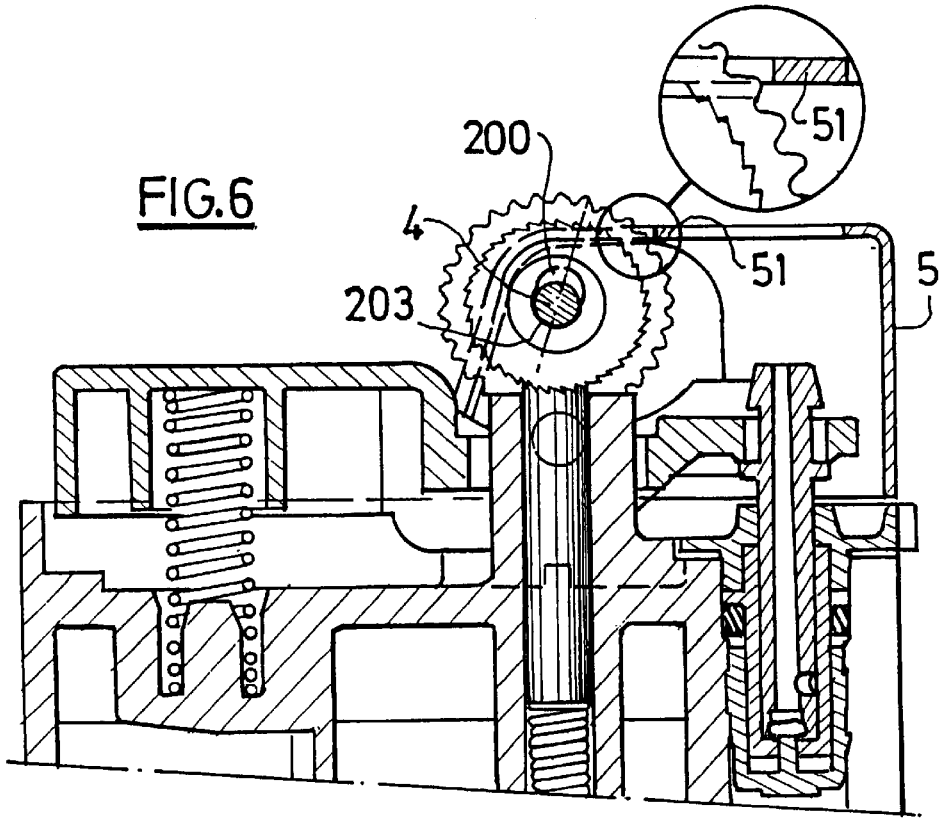

The embodiment that has just been described calls for a wheel cover 14. Such a piece is not necessary in the embodiment shown in FIGS. 5–7. As previously, the axle 4 of the wheel 2 is slidably mounted in two grooves or oblong slots 200, one on each side of the cover 4*a*, between a high position 202 and a low position 203. At rest, in an inactive or extinguished position, the spring 71 of the flint 7 pushes, via the latter, the axle 4 against the upper end 202 of the groove 200. In the example shown, the groove 200 is preferably slightly inclined with respect to the vertical. The rotation of the wheel 2 must be prohibited in this position. This result is obtained by providing the cap 5 with at least one latching lug 51 projecting inward of the lighter, which, as it appears in the enlarged inset, penetrates between two teeth 30 of at least one driver 3. In FIGS. 5 and 6, the lug 51 is shown at the tip. To unlock this engagement, it suffices to press on the drivers 3 to cause the axle 4 to slide downward and that it reaches the low position 203 shown in FIG. 6. As it appears in the annexed inset, this movement releases the driver or drivers 3 of the lug (or lugs) 51 and enables sparks to be generated.

Figure 7:
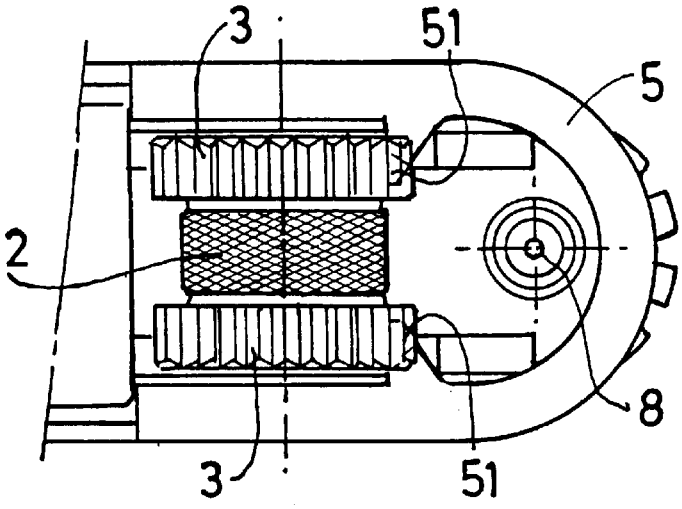

FIG. 7, which is a top view of a lighter according to the invention, shows a cap 5 provided with two lugs 51 that are symmetrical with respect to the axle 4 of the lighter. But a single lug 51 can be sufficient. As soon as the pressure on the assembly 23 ceases, the axle 4 is returned toward the top 202 of the groove 200 under the action of the spring 71. This design ensure that the pressure on the push-button 10 must occur between the rotation of the wheel 2 by the drivers 3 and the upward return of the axle 4.

Figure 8:
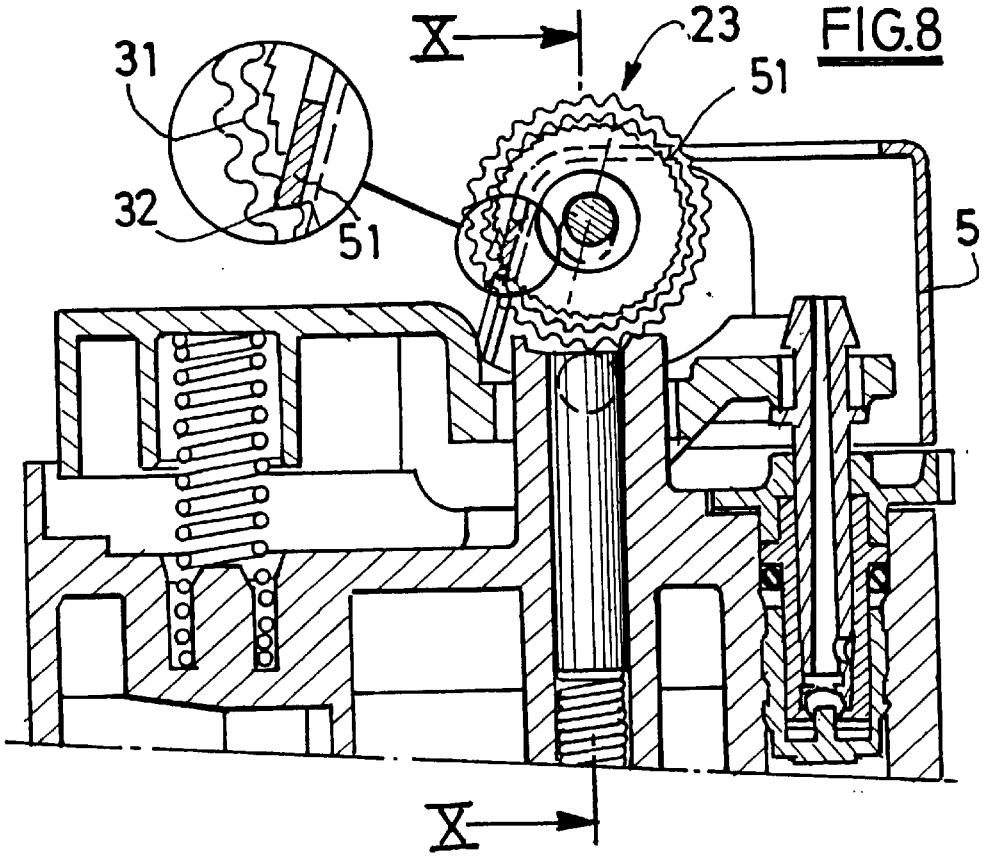
Figure 9:
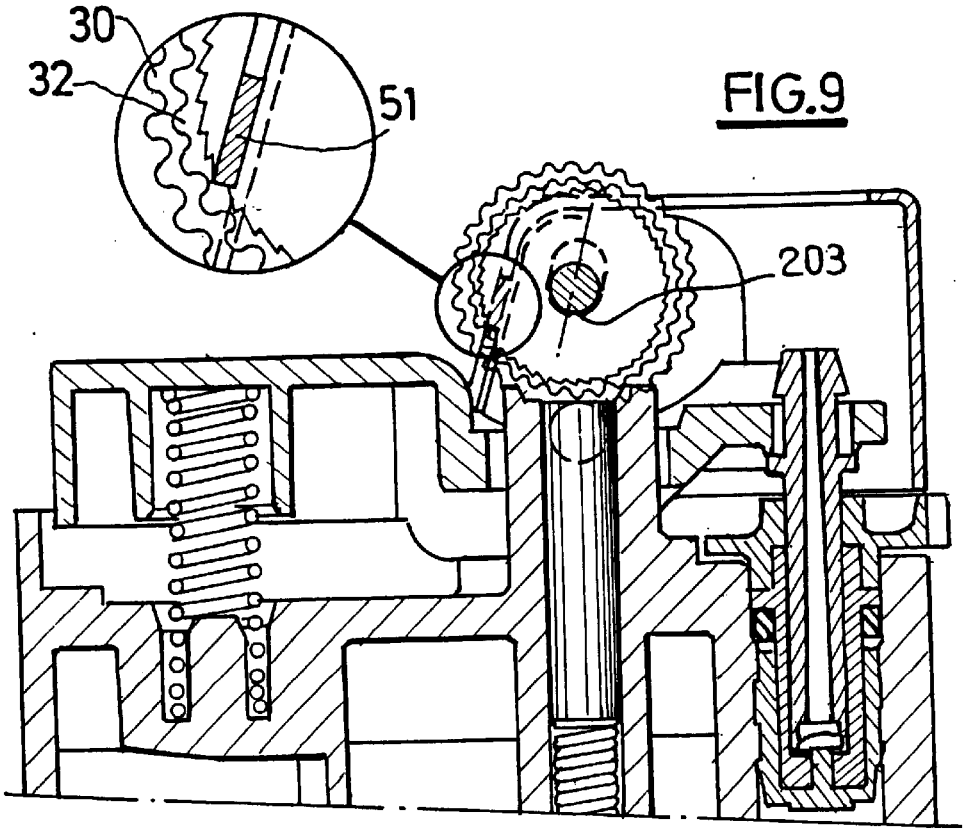

The same idea of blocking the drivers 3 is implemented in the embodiment shown in FIGS. 8–10. In these Figures, which are vertical cross-sections of a lighter according to the invention, one (or two) blocking lug 51 affixed to the cap 5 is found again. Conversely, the structure of the drivers 3 has been modified. They are constituted of a double notched crown, an external crown provided with notches or teeth 30, identical to the previous, and an internal crown 31 provided with teeth or notches 32, with a smaller diameter than that of the crown 30, respectively. The functioning of this embodiment is the same as previously, i.e., when the axle 4 is applied, by the spring 71, against the bottom 203 of the groove 200, the lug (or lugs) 51 comes into contact with the bottom or inner wall of the teeth 32, which prevents the rotation of the drivers 3. Conversely, a sufficient pressure exerted on the drivers 3 lowers the ignition assembly 23 and releases the teeth 32 of the lug 51, which enables the rotation of the wheel 2. The drivers 3 and the wheel 2 can then generate sparks, as it appears in FIG. 9 and in the annexed inset.

FIG. 10 is a cross-section along the line X—X of FIG. 8, in which the lug 51 appears better, as well as the inner toothing 32 of the driver 3 that cooperates with the lug 51 when the axle 4 is in high position, which corresponds to the resting position of FIG. 8.

Figure 11:
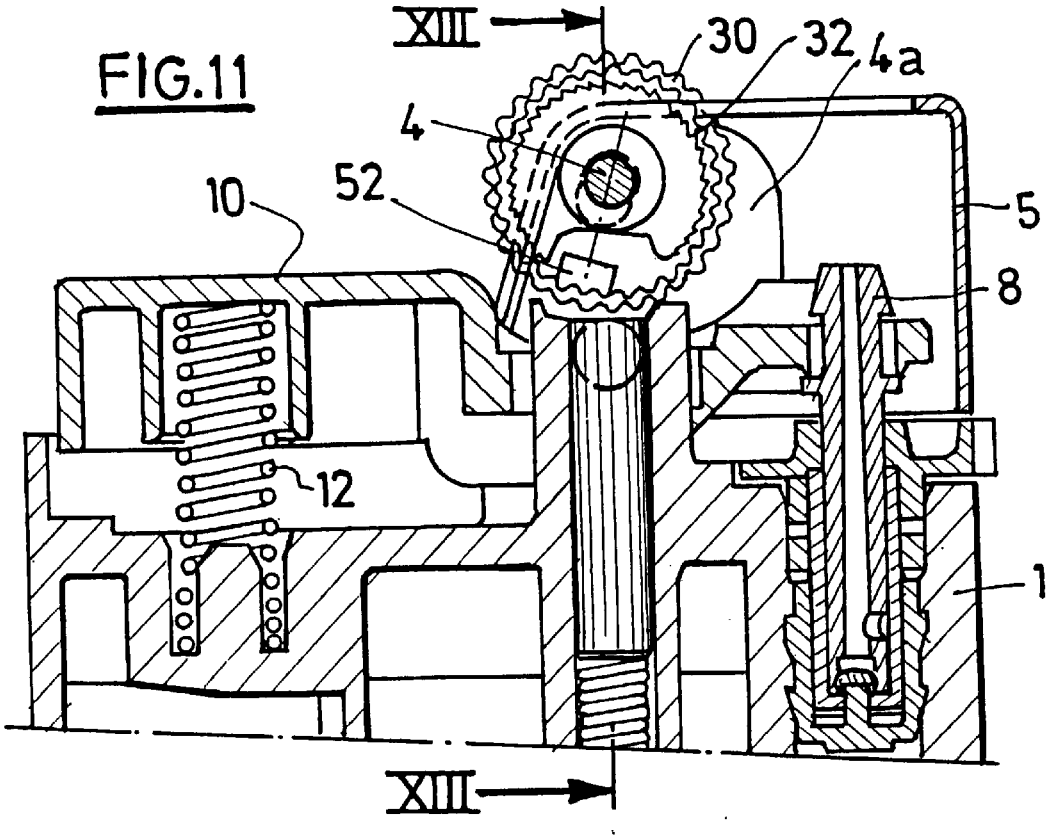
Figure 12:
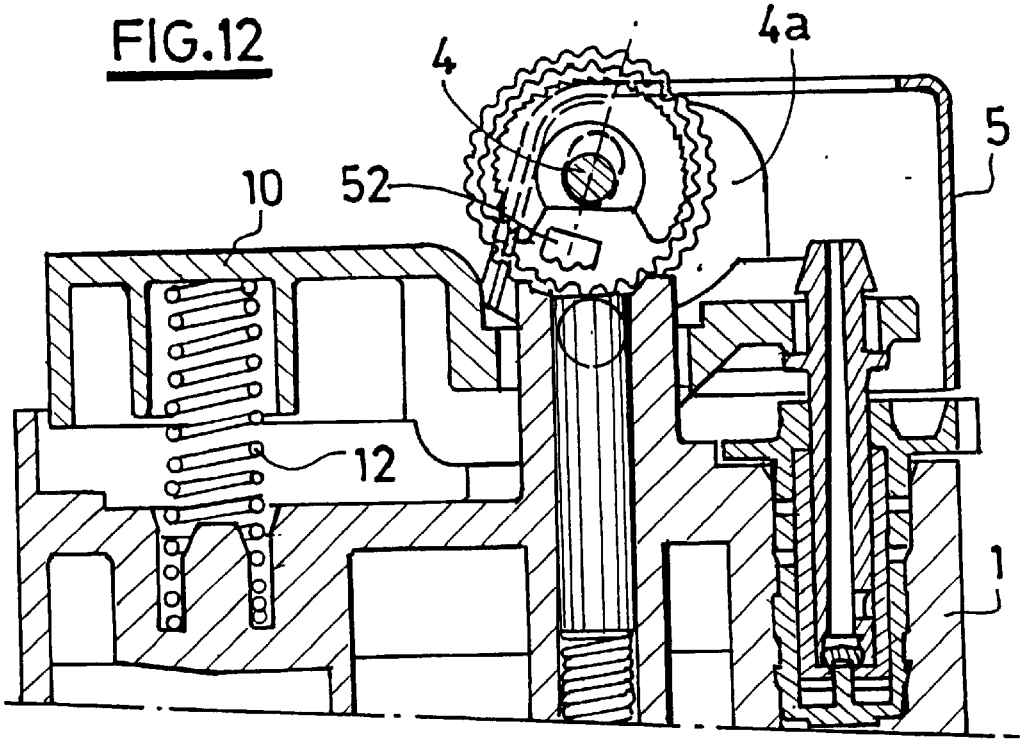

FIGS. 11 and 12 are vertical cross-sections by the symmetrical plane of the lighter, and FIG. 13 is a vertical cross-section along the line XIII—XIII of FIG. 11. They show another embodiment with driver 3, having double crowns 30, 31 and an axle 4 of the ignition assembly 23 slidably mounted in a rectilinear groove 200 that is preferably inclined with respect to the vertical. As previously, the blocking of the wheel 2 is obtained by the bearing of a lug 52 or the like against the teeth 32 of the inner crown 31. But the lug 52 is molded in the lighter body, within the cover 4*a* and projects inward of the lighter. As previously, one or two lugs 52 can be provided. It is the relative movement of the ignition assembly 23 with respect to the lug 52, which remains fixed, that produces or does not produce the blocking of at least one driver 3 by the lug 52. In FIG. 11, the lug 52 blocks the teeth 32 of the crown 31 whereas, when the assembly 23 has been lowered, as shown in FIG. 12, there is no longer any contact and the assembly 23 can rotate.

As it appears better in FIG. 13, the cap 5 is itself permanently engaged by way of the lugs 53, although it is detachable.

FIG. 14 shows another method of blocking the wheel 2 calling for a cover 4*a* having a rectilinear groove 200. In the Figure, only one rectilinear groove 200 is shown in order not to unnecessarily clutter the drawing. Of course, this groove 200, formed in the cover 4*a*, remains fixed with respect to the body 1 of the lighter when the ignition assembly 23 slides downward. This groove 200 has a notch 201 at its upper portion. Furthermore, the axle 41 is no longer circular as previously but has, on at least one of its sides, a cavity 42 whose shape corresponds to that of the notch 201. The notch 201 is provided at the upper portion 202 of the rectilinear groove 200. In the example shown, the axle 41 has a cruciform cross-section, such that there are four cavities 42. In the resting position, the spring 71 of the flint 7 pushes the ignition assembly 23 upward, which, as shown in FIG. 15, prevents the rotation of the wheel 2, the rotation of the assembly 23 being blocked by the bearing of the notch 201 in one of the cavities 42.

If the ignition assembly 23 is pressed down, this pressure causes the compression of the spring 71 of the flint 7 and the lowering of the axle 41 beneath the notch 201, such that the axle 41 can rotate and drive the wheel 2.

To prevent a child from sufficiently pressing down to bring the axle in the lower area 203, clefts 54 oriented inward of the lighter can be provided in the cap, above the lugs 53, as shown in FIG. 15. In this case, in order for the necessary lowering to occur, the flanges of the clefts 54 must be spaced apart, which requires an additional force independent of that resulting from the compression of the spring 71 of the flint 7, the axle 41 being capable of returning into high position under the sole slackening action of the spring 71.

In all of the embodiments that have just been described, in the resting or extinguished position, the rotation of the wheel 2 is blocked, the unlocking being obtained by pressing down on the ignition assembly 23, which requires a predetermined pressure that only adults can exert, followed by the rotation of the wheel 2 and a pressure on the push-button 10. In these embodiments, the unlocking comes from a variation in the level of the axle 4 of the wheel 2 with respect to the body 1 the lighter. The movements of the push-button 10 and the gas outflow remain free.

To ensure child safety, it can be merely necessary to prevent the rotation of the wheel 2 after pressing on the push-button 10, which releases the gas. The embodiment of FIGS. 16–18 makes it possible to obtain this result and no longer calls for a movable ignition assembly, but for a wheel cover 14 once again.

Figure 16:
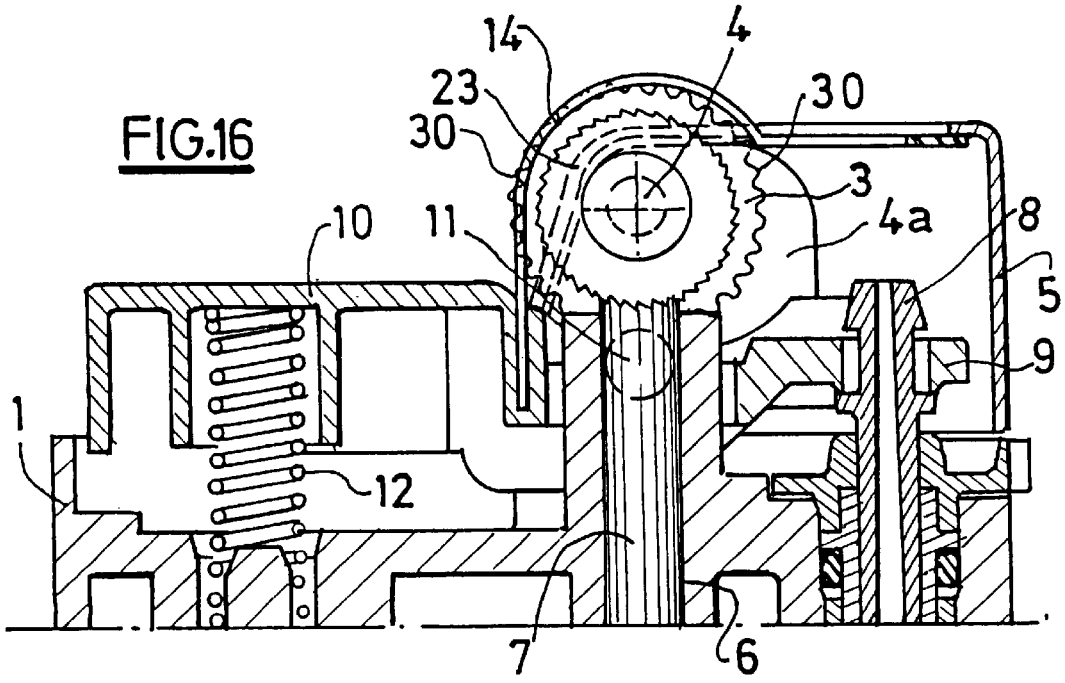
FIG. 16 shows a vertical cross-sectional view of another embodiment, in which the ignition assembly is not movable with respect to the body of the lighter, the lighter being in the extinguished position.

In FIG. 16, one sees that the wheel cover 14 is extended frontwardly by a planar or cupel-shaped plate 142 such as that which is shown in FIG. 19, taking support against the lower surface of the cap 5 on which it can slide between two positions corresponding to the extinguished and ignition positions of the lighter, the front end 147 of the plate 142 always remaining beneath the lower surface of the cap 5. The second arm 141 of the wheel cover 14 is included in a transverse slit of the lever 9, in which its lower end is fixed. A projection 143 is provided in the rear portion of the plate 142. In the extinguished or resting position, the projection 143 is outside the periphery of the teeth 30 of the drivers 3. The drivers 3 and therefore the wheel 2 that is rotationally affixed thereto can rotate. It is noted that in this position, the zone 30*a* of the teeth 30 is accessible.

Figure 17:
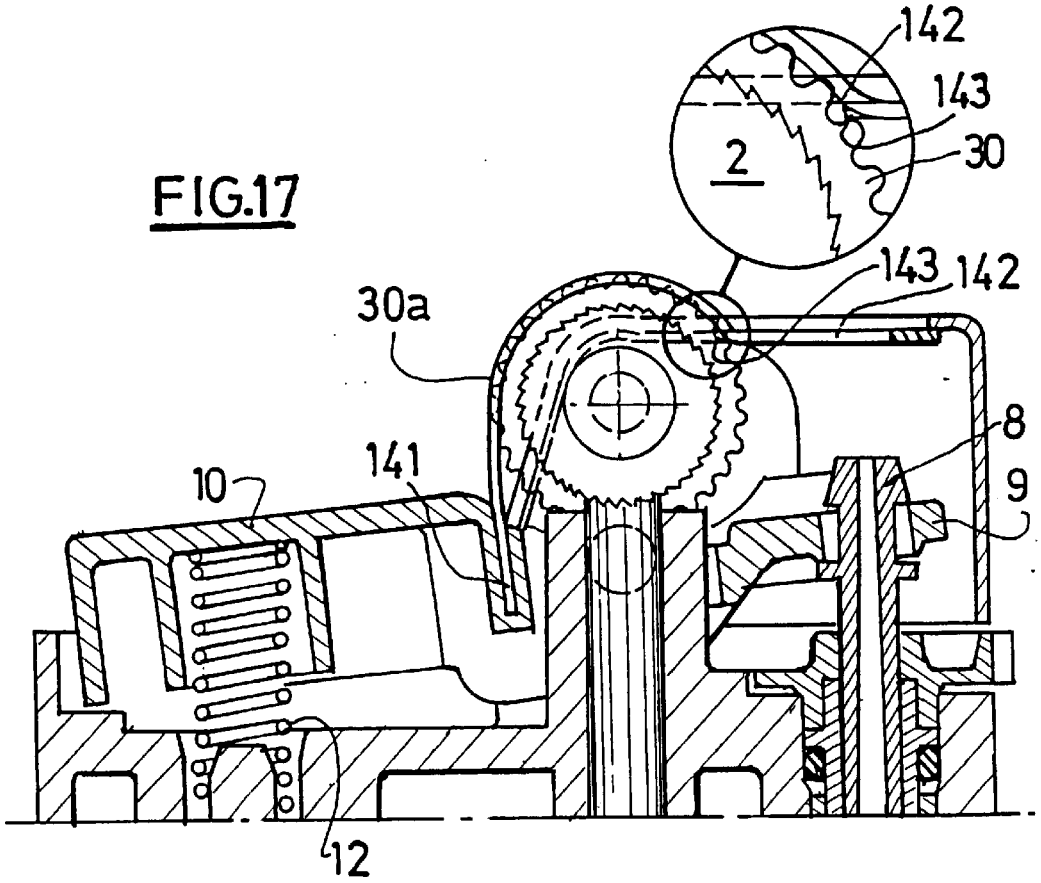
FIG. 17 shows the lighter in the ignition position, in the same conditions as in FIG. 16.

As it appears in FIG. 17, if the push-button 10 is pressed down, when the wheel 2 has been or has not been rotated, the lever 9 pivots about the axle 11. When lowering, the push-button 10 drives the arm 141 downward, but this movement produces a translation of the wheel cover 14 and of the plate 142 toward the left of the Figure, such that the teeth 30 of the zone 30*a* are now inaccessible due to a difference in curvature between the drivers 3 and the wheel cover 14 and the difference in the center of rotation. Therefore, the wheel 2 can no longer be driven by the drivers 3. During this movement, the plate 142 is also driven toward the left of the Figure, such that its rear edge or projection 143 penetrates between two teeth 30 of at least one of the drivers 3 and blocks any rotational movement thereof.

Figure 18:
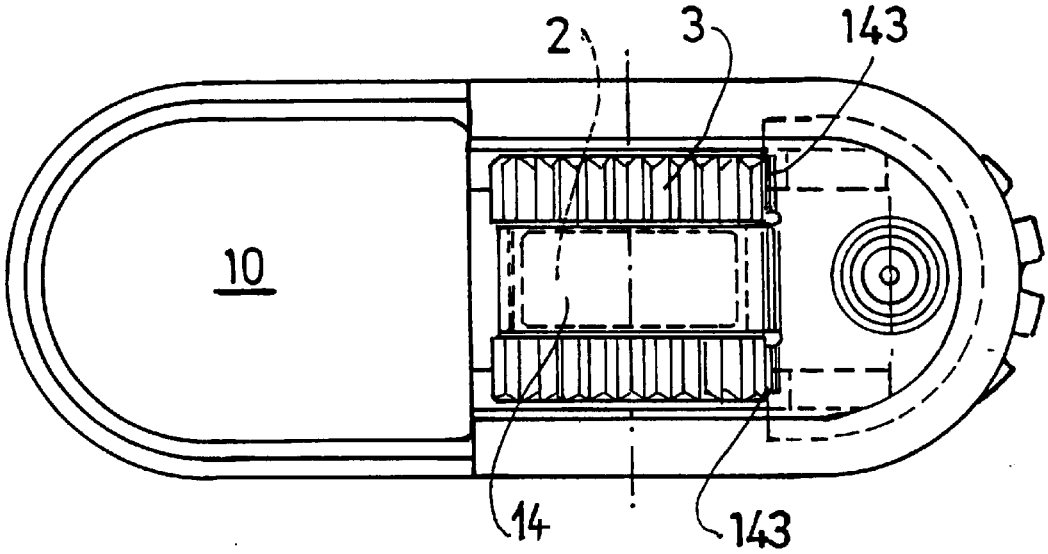
FIG. 18 shows a top view of a lighter according to the invention in the second embodiment.

FIG. 18 is a top view of a lighter in the embodiment of FIGS. 16 and 17. One sees that the wheel cover 14 surrounds the wheel 2, and that the plate 142 has a shape similar to that of the body of the lighter, the rear edge 143 of the plate penetrating between two teeth 30 of the drivers 3.

In the embodiment shown in FIGS. 16–18, the wheel cover 14 is fixed by one of its ends on the side of the push-button 10 and is extended frontwardly by a planar surface that can slide against the lower surface of the cap 5. The pressure on the push-button 10 thus causes the rearward displacement of the wheel cover 14 which rises to the level of the drivers 3. This displacement also causes the engagement of the rear edge 143 of the plate 142 with at least one of the drivers 3, which blocks the wheel 2 when the push-button 10 is pressed down. In the extinguished or resting position, the projection 143 is outside the periphery of the teeth 30 of the drivers 3. The drivers 3 and therefore the wheel 2 which is rotationally affixed thereto can rotate. It is noted that in this position, the zone 30*a* of the teeth 30 is accessible.

Figure 20:
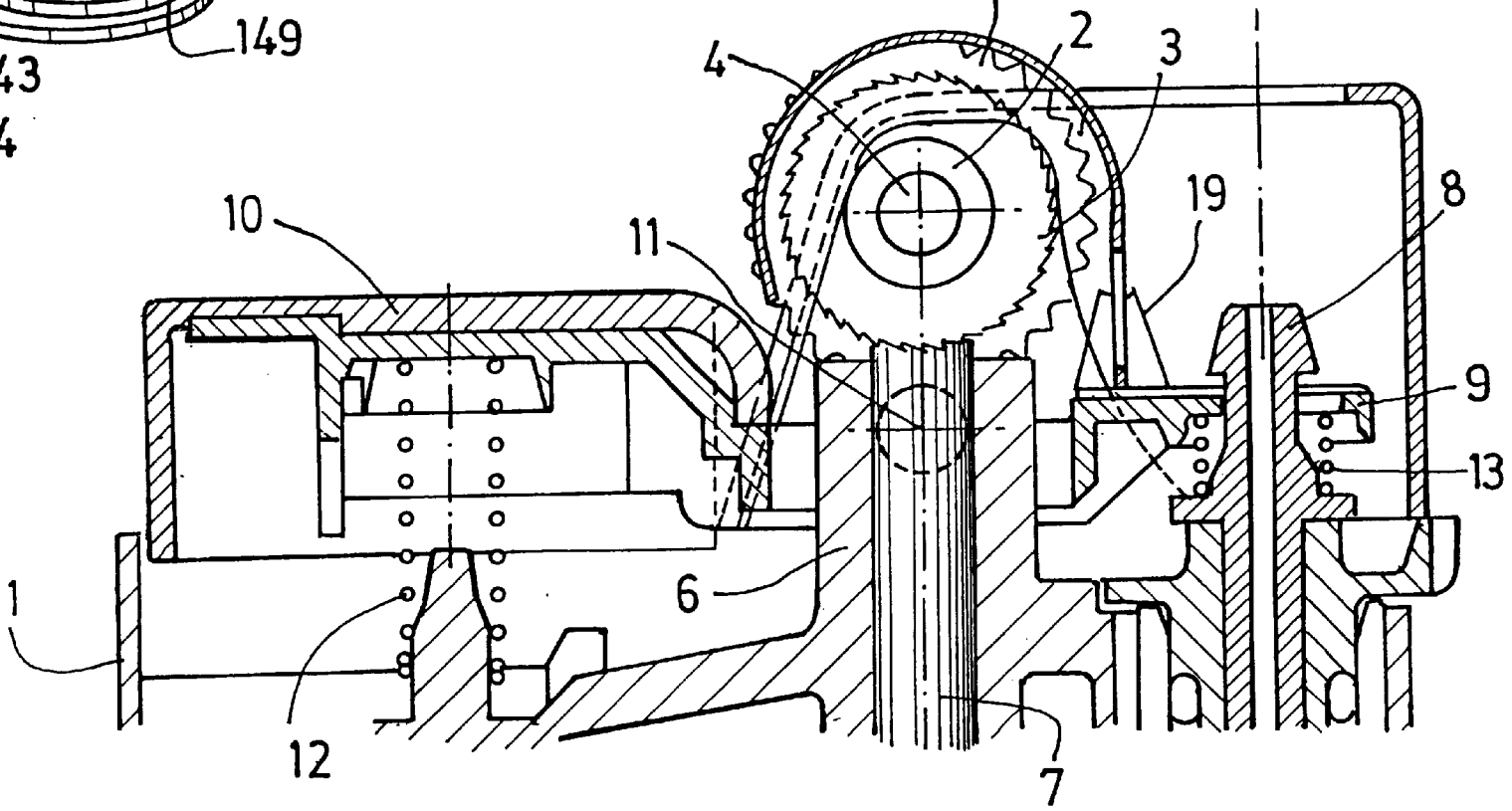
FIGS. 20 and 21 show another embodiment in which the wheel cover is fixed at the front of the push-button lever.
Figure 21:
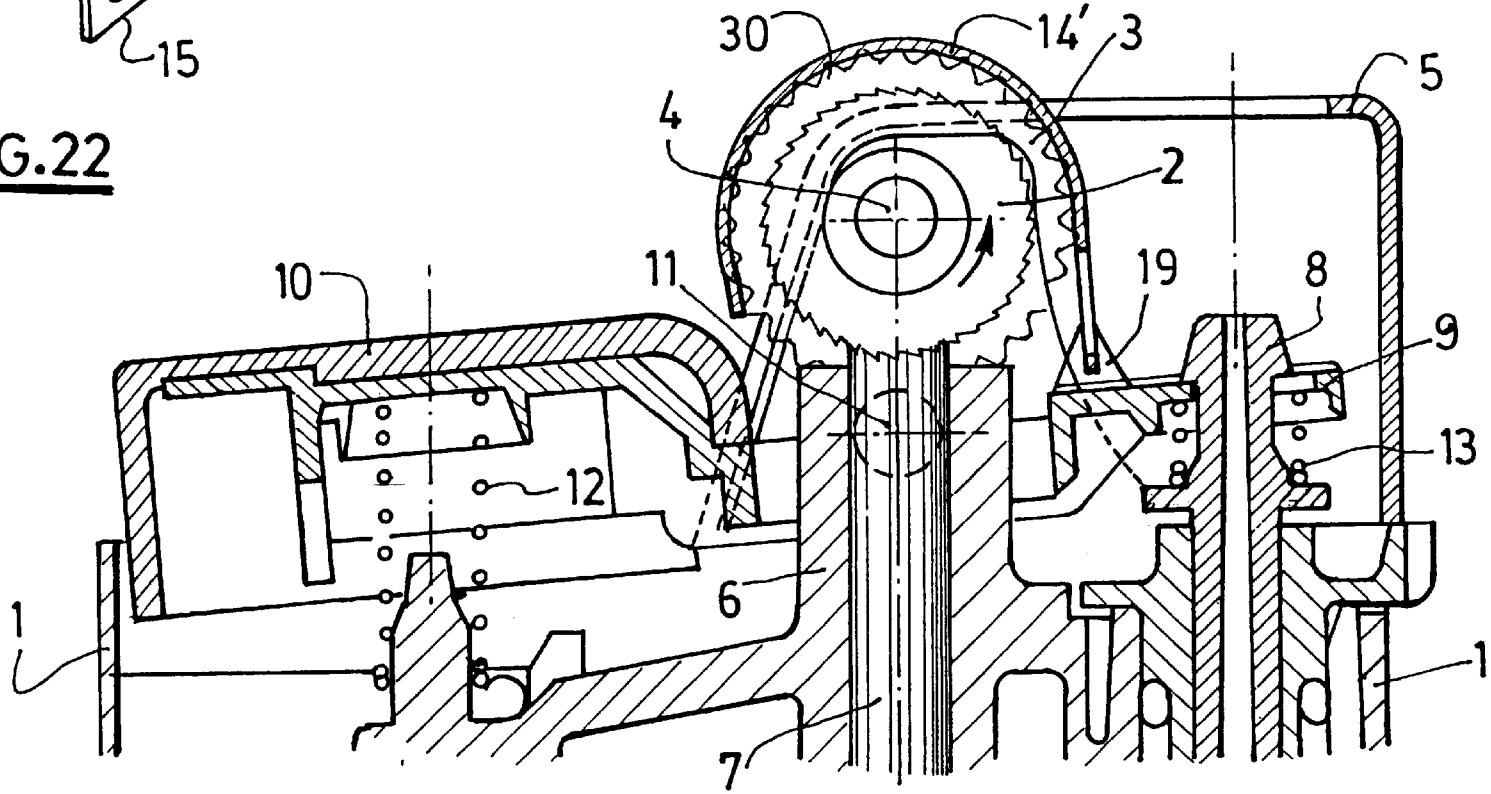

According to another embodiment of the invention shown in FIGS. 20 and 21, the wheel cover 14, whose periphery extends over about 270°, is fixed by one of its ends around the wheel 2 on the front of the lever 9, such that when the lighter is in the resting or extinguished position, the teeth 30*a* of the drivers 3 are accessible, and that when a pressure is exerted on the push-button 10, they are no longer accessible, the wheel cover 14 coming to the same level as (or to a higher level than) their peripheries in the rear area of the drivers 3. This difference in the relative position of the wheel cover 14 and of the drivers 3 comes from the fact that, during the pressure on the push-button 10, the centers of pivoting of the push-button 10 lever and of the wheel cover 14 are not the same.

As it appears in FIG. 21, if the push-button 10 is pressed down, when the wheel 2 has been or has not been rotated, the lever 9 pivots about the axle 11. When lowering, the push-button 10 drives the arm 141 downward, but this movement produces a translation of the wheel cover 14 toward the left of the Figure, such that the teeth of the zone 30*a* become inaccessible due to a difference in curvature between the drivers 3 and the wheel cover 14 and the difference in the centers of rotation. Therefore, the wheel 2 can no longer be driven by the drivers 3.

Figure 22:
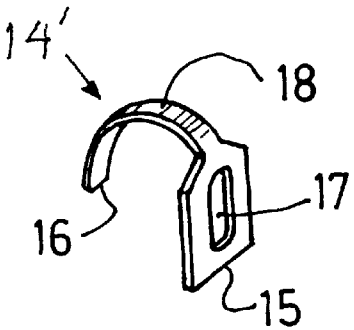
FIG. 22 is a view of a wheel cover.

FIG. 22 shows a perspective view of another wheel covering ring 14' according to the invention. As it appears in the Figure, the front portion 15 of the wheel cover 14' extends over a width that is substantially equal to the overall width of the two drivers 3, and has a slit 17 enabling the passage of the sparks. This front portion 15 is extended by a smaller portion 18 whose width is substantially equal to that of the wheel 2 and is ended by a tip 16. The edge of the portion 15 can be fixed by any way in the front portion of the lever 9 and, for example, by clipping or duplicate molding in bosses 19.

The movement of the push-button 10 about its axle 11 is translated, with respect to the the wheel 2 and the drivers 3, into a combined rotational, elevational, and translational movement, the teeth 3 projecting with respect to the wheel cover 14'. It is this combined movement that lifts the wheel cover 14' above the wheel 2 and brings it to the level of or above the teeth 30 of the drivers 3, which prohibits a pressure on the drivers 3, and therefore the driving of the wheel 2 and the production of sparks, except to adults, as mentioned with reference to FIG. 4.

Although the rigid wheel cover 14' is fixed by its front end 15 in the embodiment that has just been described, it can be fixed by both its front and rear ends on the front and rear of the lever, respectively, with respect to the wheel, the wheel cover moving as the push-button lever 9.

It is understood that numerous alternative embodiments can be provided, especially by substitution of equivalent technical means, without leaving the scope of the invention.

What is claimed is:

1. A gas lighter having a safety mechanism, the lighter comprising:

a lighter body housing a tank of liquefied gas under pressure;

a valve allowing passage of gas;

a burner connected to the valve;

a push-button disposed on the body and adapted to be pressed by a user's finger;

a lever for acting on the valve, the lever being adapted to cooperate with the push-button;

a wheel for engaging a flint, the wheel comprising at least one driver;

a spring arranged below the flint for biasing the flint against the wheel;

a axle upon which the wheel is rotatably mounted; and a mechanism for preventing the rotation of the wheel;

the mechanism comprising a wheel cover having one end which movably engages the wheel, a portion which extends over a part of the wheel, and another end that is coupled to the push button, wherein the mechanism is adapted to engage at least one tooth on the at least one driver so as to prevent the rotation of the wheel.

2. The lighter of claim 1, wherein the wheel comprises at least two drivers, one located on each side of the wheel.

3. The lighter of claim 1, further comprising a cover disposed in an upper portion of the lighter and a cap at least partially surrounding the cover.

4. The lighter of claim 3, wherein the axle is supported by the cover.

5. The lighter of claim 1, wherein the axle is movable against a biasing force of the spring.

6. The lighter of claim 1, wherein the axle is movably supported in a slot.

7. The lighter of claim 1, further comprising a cover disposed adjacent the wheel;

wherein the axle is movably mounted in rectilinear grooves disposed in the cover, and wherein the axle is movable between a low position in which the wheel is able to rotate without the push button being pressed and unable to rotate when the push button is pressed and a high position in which the wheel is prevented from rotating.

8. The lighter of claim 1, wherein the wheel cover comprises a plate having an edge and wherein the edge is adapted to engage the at least one tooth of the at least one driver so as to prevent the rotation of the wheel.

9. The lighter of claim 8, wherein the axle is movable between a high position and a low position and wherein the edge is adapted to engage the at least one tooth when the axle is in the high position.

10. The lighter of claim 1, wherein the end of the wheel cover that movably engages the wheel comprises a plate having a hole and an edge and wherein the edge is adapted to engage the at least one tooth of the at least one driver so as to prevent the rotation of the wheel.

11. A gas lighter having a safety mechanism, the lighter comprising:

a lighter body housing a tank of liquefied gas under pressure;

a valve allowing passage of gas;

a burner connected to the valve;

a push-button disposed on the body and adapted to be pressed by a user's finger;

a lever for acting on the valve, the lever being adapted to cooperate with the push-button;

a wheel for engaging a flint, the wheel comprising at least one driver;

a spring arranged below the flint for biasing the flint against the wheel;

an axle upon which the wheel is rotatably mounted; and a mechanism for preventing the rotation of the wheel;

wherein the mechanism is adapted to engage at least one tooth on the at least one driver so as to prevent the rotation of the wheel, wherein the mechanism for preventing the rotation of the wheel comprises a wheel cover, wherein the wheel cover comprises a plate having an edge and wherein the edge is adapted to engage the at least one tooth of the at least one driver so as to prevent the rotation of the wheel, and wherein the plate of the wheel cover is slidable with respect to an inner surface of a cap surrounding the burner.

12. The lighter of claim 11, wherein the wheel cover is one of fixed to the lever and connected to the lever.

13. The lighter of claim 11, wherein the wheel cover comprises an end which is fixed to the lever via a connection, the connection being disposed between the wheel and the push-button.

14. A gas lighter comprising:

a lighter body housing a tank of liquefied gas under pressure;

a valve allowing a passage of gas;

a burner connected to the valve;

a push-button disposed on the body and adapted to be pressed by a user's finger;

a lever for acting on the valve, the lever being adapted to cooperate with the push-button;

a wheel for engaging a flint, the wheel comprising two drivers;

a spring arranged below the flint for biasing the flint against the wheel;

an axle mounted to a cover;

the axle being movable between a high position and a low position;

the wheel being rotatably mounted via the axle;

a cap at least partially surrounding the cover;

a wheel cover for preventing the rotation of the wheel;

the wheel cover having a portion which at least partially surrounds the wheel;

the wheel cover comprising an end which is coupled to the push-button and another end which is free;

the other end including a plate adapted to slide with respect to an inner surface of the cap;

the plate comprising an edge adapted to engage at least one tooth of at least one of the drivers, wherein the wheel is prevented from rotating when the edge engages at least one tooth of at least one driver, and wherein the wheel is rendered rotatable when the axle of the wheel is moved away from the high position towards the low position.

15. The lighter of claim 14, wherein the wheel is prevented from rotating when the push-button is in a low position, and wherein the wheel is rendered rotatable when the axle of the wheel is moved away from the high position towards the low position.

16. The lighter of claim 14, wherein the wheel is prevented from rotating by the edge engaging at least one tooth of at least one driver when the axle is in the low position and the push-button is in a low position.

17. A gas lighter having a safety mechanism, the gas lighter comprising:

a lighter body housing a tank of liquefied gas under pressure;

a valve allowing a passage of gas;

a burner connected to the valve;

a push-button disposed on the body and adapted to be pressed by a user's finger;

a lever for acting on the valve, the lever being adapted to cooperate with the push-button;

a wheel for engaging a flint, the wheel comprising two drivers;

a spring arranged below the flint for biasing the flint against the wheel;

an axle mounted to a cover;

the axle being movable between a high position and a low position;

the wheel being rotatably mounted via the axle;

a cap at least partially surrounding the cover;

a wheel cover for preventing the rotation of the wheel;

the wheel cover having a portion which at least partially surrounds the wheel;

the wheel cover comprising an end which is coupled to the lever and another end which is free;

the free end having an edge adapted to engage at least one tooth of at least one of the drivers, wherein the wheel is prevented from rotating when the axle is in the high position by the edge engaging at least one tooth of at least one driver, and wherein the wheel is rendered rotatable when the axle is moved away from the high position to the low position.

18. The lighter of claim 17, wherein the wheel is prevented from rotating by the edge engaging at least one tooth of at least one driver when the axle is in the low position and the push-button is in a low position.

* * * * *